US008770792B2

(12) United States Patent
de Bevilacqua

(10) Patent No.: US 8,770,792 B2
(45) Date of Patent: Jul. 8, 2014

(54) VARIABLE CONFIGURATION LIGHTING APPARATUS

(76) Inventor: Carlotta Francesca Isolina Maria de Bevilacqua, Milan (IT)

( * ) Notice: Subject to any disclaimer, the term of this patent is extended or adjusted under 35 U.S.C. 154(b) by 540 days.

(21) Appl. No.: 13/083,293

(22) Filed: Apr. 8, 2011

(65) Prior Publication Data

US 2011/0273884 A1 Nov. 10, 2011

(30) Foreign Application Priority Data

Apr. 9, 2010 (IT) ..... MI2010A0610

(51) Int. Cl.
*F21S 4/00* (2006.01)

(52) U.S. Cl.
USPC ..... 362/249.02; 362/217.01; 362/555; 362/217.12

(58) Field of Classification Search
USPC ..... 362/249.02, 217.01, 217.12, 217.13, 362/217, 17, 555
See application file for complete search history.

(56) References Cited

U.S. PATENT DOCUMENTS 8,454,194 B2 * 6/2013 Liu ..... 362/218
2008/0151546 A1 6/2008 Tsai

FOREIGN PATENT DOCUMENTS

EP 1 906 080 A1 4/2008

OTHER PUBLICATIONS

Italian Search Report No. IT MI20100610, dated Nov. 17, 2010.

* cited by examiner

*Primary Examiner* — Anabel Ton
(74) *Attorney, Agent, or Firm* — Venable LLP; Robert Kinberg

(57) ABSTRACT

A lighting variable configuration apparatus comprises a plurality of ring-shaped bodies, arranged about a central axis and provided with respective plurality of lighting sources, in particular LEDs, and connected to one another by means of joints in such a way to be differently oriented with respect to one another; the bodies are connected to one another by means of pins made of electric conductive material which contact respective pairs of terminals arranged on adjacent bodies, so that the adjacent bodies are rotational with respect to one another by means of the pins and are electrically connected by means of the same pins.

17 Claims, 3 Drawing Sheets

VARIABLE CONFIGURATION LIGHTING APPARATUS

The present invention relates to a variable configuration lighting apparatus.

BACKGROUND OF THE INVENTION

Various types of lighting apparatuses which may assume different spatial configurations, also to vary the light distribution, are known.

In general, apparatuses of this type comprise several lighting bodies, each of which provided with one or more lighting sources, and connected by means of articulation mechanisms which allow to vary the orientation of the various lighting bodies with respect to one another.

The light sources carried by the various lighting bodies are powered and controlled by means of traditional electric wires; the presence of these wires makes the construction of the apparatuses complicated and limits the possible configurations, unless particular complex connections are used, above all if a high number of lighting sources on the various lighting bodes are provided.

The known variable configuration apparatuses do not appear fully satisfactory, above all in terms of construction simplicity, efficiency and versatility.

SUMMARY OF THE INVENTION

It is an object of the present invention to provide a variable configuration lighting device which is at least equally if not more efficient, simple and versatile than the known solutions.

The present invention thus relates to a variable configuration lighting device as disclosed in essential terms in appended claim 1 and the additional features of which are disclosed in the dependent claims.

The apparatus of the invention is simple to make and to install, fully efficient, reliable and very versatile. In particular, the apparatus of the invention, while being very simple and relatively cost-effective to make, may easily assume various spatial configurations, and thus allows to obtain very different lighting configurations from one another also in presence of many lighting sources.

BRIEF DESCRIPTION OF THE DRAWINGS

Further features and advantages of the present invention will be apparent in the description of the following non-limitative embodiments, with reference to the figures of the accompanying drawings, in which.

DETAILED DESCRIPTION OF THE INVENTION

Figure 1:
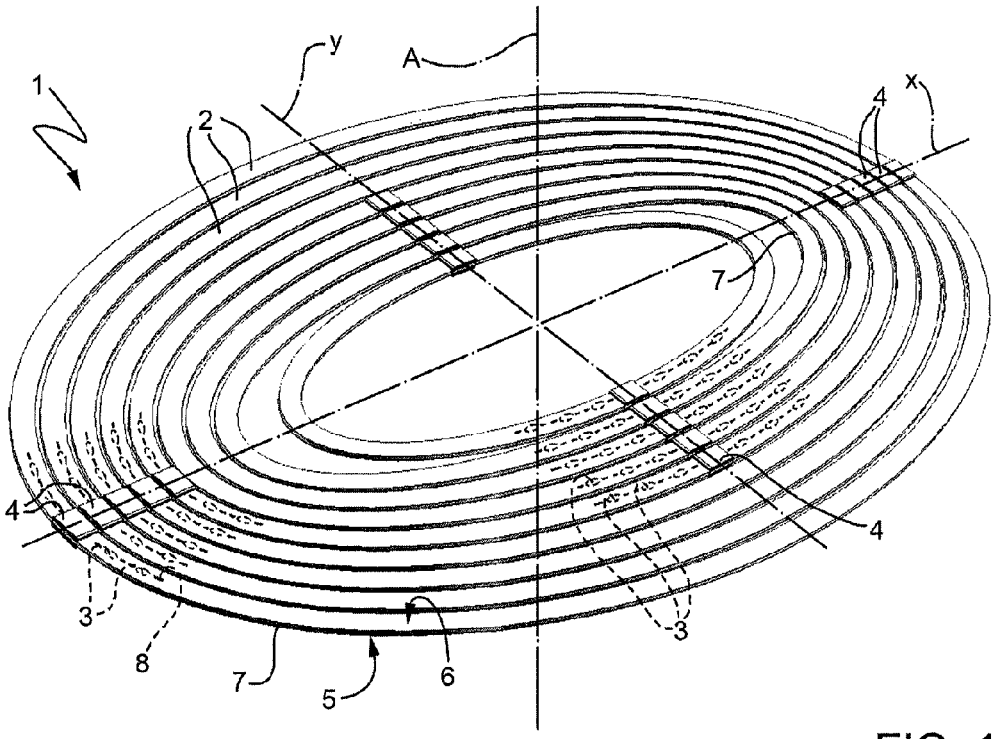
FIG. 1 is a perspective diagrammatic view of a variable configuration lighting apparatus in accordance with a first embodiment of the invention.

In FIG. 1 numeral 1 indicates a variable configuration lighting apparatus as a whole.

The apparatus 1 may be used, for example, as ceiling light, by means of wires which hang it to a supporting element fixable to a ceiling (not shown for the sake of simplicity); it is in all cases understood that apparatus 1, possibly provided with suitable supporting element, may be used for other types of lamps (e.g. floor lamps, wall lamps, etc.).

The apparatus 1 comprises a plurality of ring-shaped bodies 2, inserted substantially one behind the other and arranged (at least in an initial configuration shown in FIG. 1) about a central axis A (vertical in use); the bodies 2 are provided with respective light sources 3, in particular LEDs (power LEDs), and connected to one another by means of joints 4 in such a way to be differently oriented with respect to one another.

According to a preferred embodiment, the bodies 2 are made of aluminium and are, for example, obtained from a sheet of aluminium of appropriate thickness which is cut to obtain the bodies 2.

In the embodiment shown in FIG. 1, the bodies 2 are substantially flat and have substantially elliptical shape.

Figure 2:
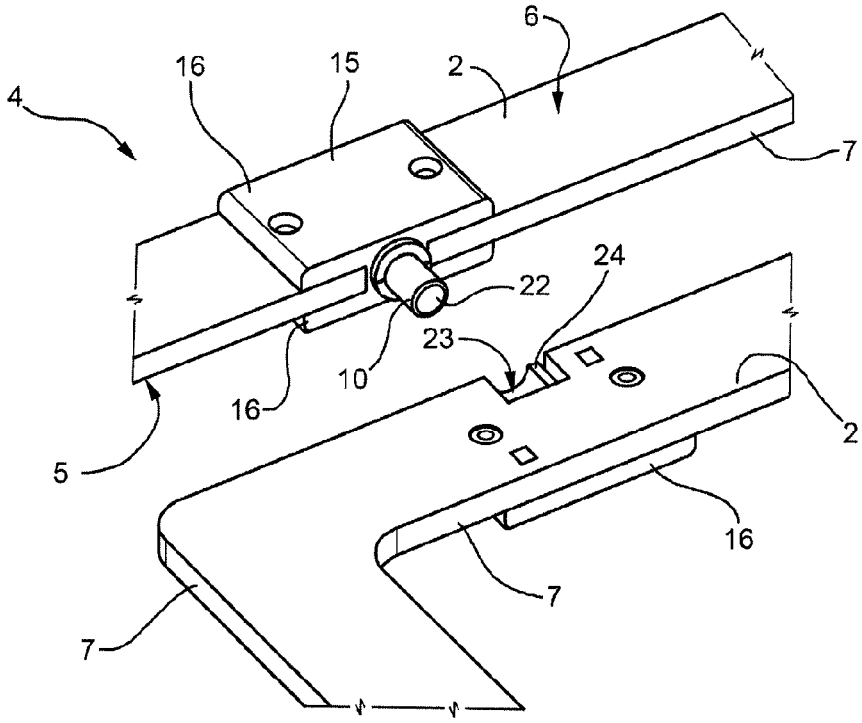
FIG. 2 is a partially exploded diagrammatic view, with parts removed for clarity, of a detail of the apparatus in FIG. 1.
Figure 3:
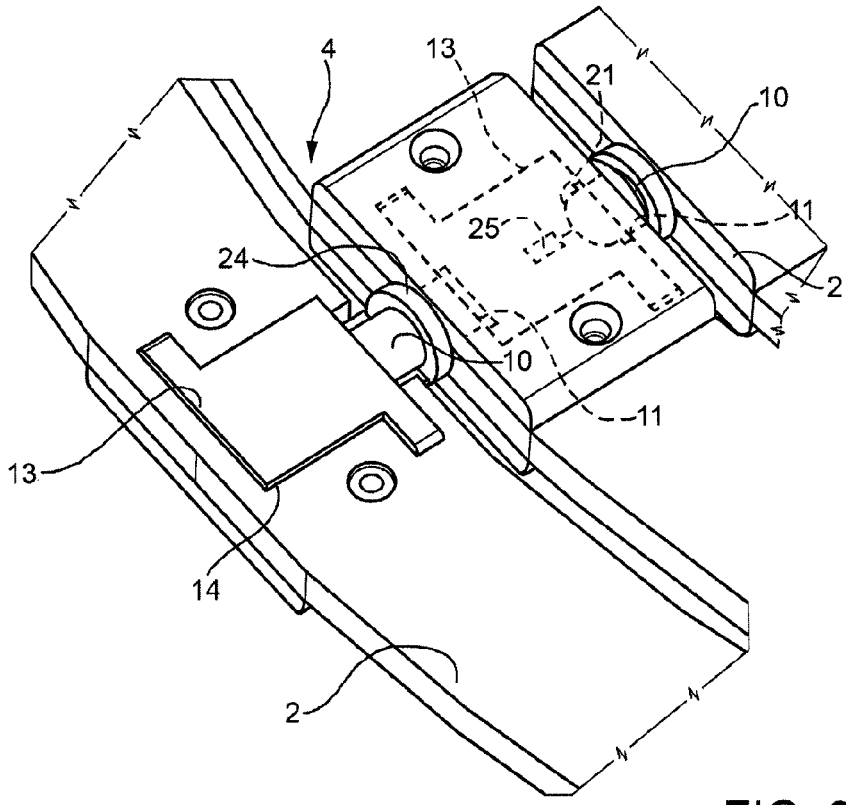
FIG. 3 is a diagrammatic view, with parts removed for clarity, of a further detail of the apparatus in FIG. 1.

With reference also to FIGS. 2 and 3, each body 2 is delimited by two opposite, substantially ring-shaped faces 5, 6, preferably flat and parallel, and by a pair of concentric side edges 7; the LEDs 3 are preferably arranged on one of the faces 5, 6 (all the LEDs 3 of a body being arranged on the same face, e.g. face 5) and extend therefrom, possibly associated to respective optical elements (lenses or other), not shown for the sake of simplicity.

Each body 2 carries a plurality of LEDs 3, arranged circumferentially spaced one from the other along the body 2 on the face 5, and an electric circuit, for example also applied to the face 5, which connects all the LEDs 3 arranged on the body 2 in series.

For the sake of simplicity, only some of the LEDs 3 and only some segments of the circuit 8 arranged on some of the bodies 2 are shown in FIG. 1.

The joints 4 comprise respective pins 10 which connect the bodies 2 to one another; the pins 10 are made of electric conductive material (e.g. copper) and contact respective pairs of electric terminals 11 arranged on adjacent bodies 2, so that adjacent bodies 2 are rotational with respect to one another about the pins 10 and are electrically connected by means of the pins 10.

In other terms, the pins 10 work as rotation hinges to allow the rotation of the bodies 2 with respect to one another, and electric connections to carry current from one body 2 to the other without requiring electric wires.

Advantageously, as shown in FIG. 1, each body 2 is supported by a pair of aligned, diametrically opposite pins 10, arranged on opposite ends of the body 2.

In the embodiment in FIG. 1 (but not necessarily), the apparatus comprises a first group of bodies 2 connected by pins 10 aligned along a first direction X, and a second group of bodies 2 connected by pins 10 aligned along a second direction Y distinct from the first direction and preferably orthogonal to the first direction X. The bodies 2 of the first body are all adjacent with respect to one another and radially external with respect to the bodies 2 of the second group.

More in detail, the bodies 2 are provided with respective electric conductive blocks 13, accommodated in respective housing seats 14 formed in the bodies 2 and the pins 10 are arranged in pairs of blocks 13 carried by adjacent bodies 2.

Each block 13 is provided with a terminal pair 11, e.g. defined by opposite surfaces of the block 13 and is connected to a circuit 8.

Advantageously, each block 13 is covered by a covering shell 15 (e.g. made of filled polymeric material, such as nylon, or composite material) formed by a pair of applied half-shells 16 (fixed in releasable manner, e.g. by means of screws) on opposite faces 5, 6 of a body 2.

Each pin 10 has a first axial end 21, mechanically connected to a block 13 of a first body 2, and second axial end 22, opposite to the end 21 which extends towards a block 13 of a second body 2, adjacent of the first body.

The ends 21, 22 of each pin 10 are housed in respective, substantially cylindrical seats 23 (or in all cases shaped so as to allow the rotation of the pins 10 with respect to the seats 23), formed on adjacent bodies 2 and delimited by respective pairs of opposite separable pairs 24, which are, for example, replaced by respective portions of the half-shells 16.

The ends 21, 22 are in contact with respective electric terminals 11, arranged on adjacent bodies 2 each of which is connected to the LEDs 3 of a body 2.

The joints 4 further comprise elastic elements 25 (known and only diagrammatically indicated in the FIG. 3), e.g. integrated or inserted in the blocks 13; the elastic elements 25 are configured so as to axially push the pins 10; in particular, each pin 10 is loaded by an elastic element 25 which cooperates with an end 21 of the pin 10 and axially pushes the pin 10.

The same elastic elements 25 also work as clutch elements, exerting on the pins 10 a force which opposes the rotation of the adjacent bodies 2.

Alternatively, other angular clutch elements of known type may be provided, adapted in all cases to contrast the rotation of the two adjacent bodies 2 and maintain them in a predetermined position.

Figure 4:
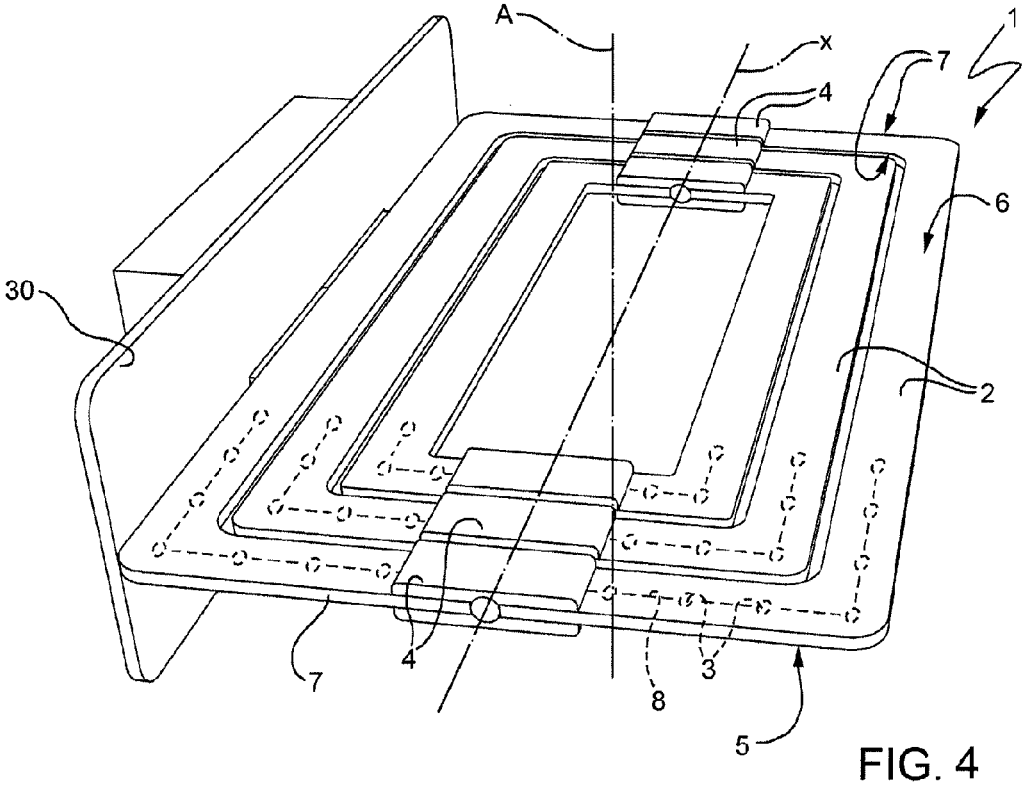
FIG. 4 is a perspective diagrammatic view of a variable configuration lighting apparatus in accordance with a first embodiment of the invention.

In the embodiment in FIG. 4, in which details similar or equal to those already described are indicated with the same numbers, the apparatus 1 is a wall lamp and comprises supporting element 30 fixable to the wall.

In this case, the bodies 2 are substantially polygonal (specifically quadrangular), optionally with round vertexes.

The supporting element 30 mechanically supports a radially external body 2; the bodies 2 are connected to one another by means of pins 10 which are all substantially parallel and preferably aligned along a single direction X.

Figure 5:
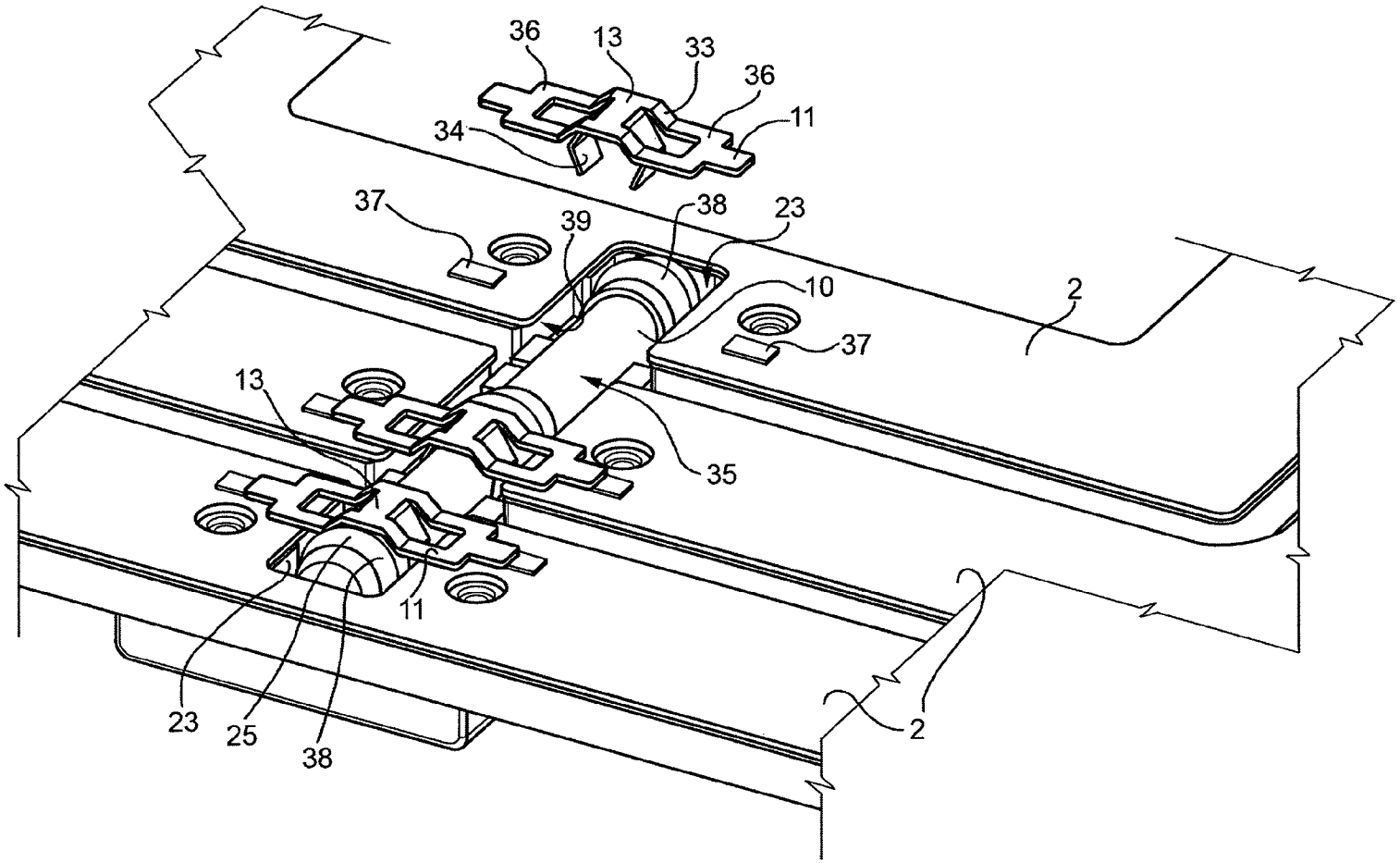
FIG. 5 is a diagrammatic view, with parts removed for clarity, of a further detail shown in FIG. 2-3.

In the variant shown in FIG. 5, more than two bodies 2 are connected to one another by means of a pin 10 which, instead of being arranged between only two adjacent bodies 2, supports a higher number of bodies 2 (three or more).

In particular, the pin 10 extends between two end bodies 2, arranged on respective ends 21, 22 axially opposite to the pin 10, and crosses one or more other intermediate bodies 2, arranged between the end bodies 2.

The pin 10 is made of electric conductive material (e.g. copper or gold-plated brass) and contacts a plurality of electric terminals 11 arranged on respective bodies 2, so that the bodies 2 are rotational with respect to one another about the pin 10 and are electrically connected by means of the pin 10.

The bodies 2 are again provided with respective electric conductive blocks 13, which include the terminals 11; on each body 2, each block 13 electrically connects the pin 10 to the circuit 8 and thus to the LEDs 3 carried on the same body 2.

In greater detail, each block 13 comprises a clip defining a terminal 11 and made of conductive material, e.g. gold-plated phosphor bronze; each clip 33 has a central gripper part 34, which is fitted about the pin 10 and contacts a side surface 35 of the pin 10, and two side arms 36 which contact respective contact plates 37 of the circuit 8.

The pin 10 is accommodated in seats 23 formed on respective bodies 2 and having, for example, a structure similar to that previously described and thus, for example, substantially cylindrical (or in all cases shaped to allow the rotation of the pins 10 with respect to the seats 23).

The pin 10 is provided with radially external elastic sealing rings 38 (o-rings), e.g. made of elastomeric material or preferably insulating material, arranged in the seats 23 and cooperating with respective walls 39 of the seats 23; preferably, the pin 10 has at least one ring 38 cooperating with each body 2 (accommodated in a seat 23).

The rings 38 constitute respective elastic elements 25 acting on the pin 10 and configured so as to push the pin 10 radially (instead of axially as previously described); also in this case, the elastic elements 25 (i.e. the rings 38) define respective friction elements, exerting on the pin 10 a force which opposes the rotation of adjacent bodies 2 (being each ring 38 pressed by interference between the surface 35 of the pin 10 and the wall 39 of a seat 23).

Moreover, it is understood that further changes and variations can be made to the lighting apparatus described and shown herein without departing from the scope of protection of the appended claims.

The invention claimed is:

1. A variable configuration lighting apparatus, comprising a plurality of ring-shaped bodies, positioned about a central axis (A) and provided with respective plurality of lighting sources, in particular LEDs, and connected to one another by means of joints comprising pins so as to be differently oriented with respect to one another; the plurality of ring-shaped bodies being connected to one another by means of the pins made of electric conductive material and which contact pairs of electric terminals arranged on adjacent ring-shaped bodies, so that the adjacent ring-shaped bodies are rotational with respect to one another by means of the pins and are electrically connected by means of the same pins; the apparatus being characterized in that pairs of adjacent ring-shaped bodies are connected by at least one pin which supports the two ring-shaped bodies and contacts respective electric conductor blocks arranged on both said adjacent ring-shaped bodies and which include the terminals; and in that on each ring-shaped body each block contacts the pin and connects the pin to an electric circuit which supplies the sources arranged on the same ring-shaped body.

2. An apparatus according to claim 1, wherein the pins have respective pairs of opposite axial ends which are housed in respective seats formed on adjacent ring-shaped bodies, each seat being delimited by a pair of separable opposed elements.

3. An apparatus according to claim 1, wherein each pin has a first axial end, mechanically connected to a block of a first ring-shaped body, and a second axial end which projects towards a block of a second ring-shaped body, adjacent to the first ring-shaped body.

4. An apparatus according to claim 1, wherein each block is covered by a cover shell formed by a pair of half-shells applied on opposed faces of a ring-shaped body.

5. An apparatus according to claim 1, wherein the joints comprise elastic elements which axially and/or radially push the pins.

6. An apparatus according to claim 1, wherein the joints comprise friction elements, which exert on the pins and/or on adjacent ring-shaped bodies a force that opposes the rotation of adjacent ring-shaped bodies.

7. An apparatus according to claim 1, wherein the ring-shaped bodies are delimited by two substantially ring-shaped, parallel opposed faces and by a pair of concentric side edges; and the sources are carried by one of said faces.

8. An apparatus according to claim 1, wherein each ring-shaped body is connected to another ring-shaped body by means of two pins aligned and diametrically opposed to each other.

9. An apparatus according to claim 1, comprising a first group of ring-shaped bodies connected by pins aligned along a first direction, and a second group of ring-shaped bodies connected by pins aligned along a second direction distinct from the first direction and preferably orthogonal to the first direction.

10. An apparatus according to claim 1, wherein all the pins are substantially aligned.

11. An apparatus according to claim 1, wherein more than two ring-shaped bodies are connected to one another by means of a pin which supports said ring-shaped bodies.

12. An apparatus according to claim 11, wherein each pin extends between two end ring-shaped bodies, arranged on respective ends axially opposite to the pin, and crosses one or more intermediate ring-shaped bodies, arranged between the end ring-shaped bodies.

13. An apparatus according to claim 1, wherein each block comprises an elastic clip defining a terminal made of conductive material.

14. An apparatus according to claim 13, wherein each clip has a central gripping part, which is fitted about the pin and contacts a side surface of the pin, and two side arms which contact respective contact plates of the circuit.

15. An apparatus according to claim 1, wherein the pins are provided with radially external elastic sealing rings, cooperating with respective walls of the seats in which the pins are accommodated; the rings defining respective elastic elements acting on the pins like friction elements.

16. A variable configuration lighting apparatus, comprising a plurality of ring-shaped bodies, positioned about a central axis (A) and provided with respective plurality of lighting sources, in particular LEDs, and connected to one another by means of joints comprising pins so as to be differently oriented with respect to one another; the plurality of ring-shaped bodies being connected to one another by means of the pins made of electric conductive material and which contact pairs of electric terminals arranged on adjacent ring-shaped bodies, so that the adjacent ring-shaped bodies are rotational with respect to one another by means of the pins and are electrically connected by means of the same pins; the apparatus being characterized in that pairs of adjacent ring-shaped bodies are connected by at least one pin which supports the two ring-shaped bodies and contacts respective electric conductor blocks arranged on both said adjacent ring-shaped bodies and which include the terminals; and in that on each ring-shaped body each block contacts the pin and connects the pin to an electric circuit which supplies the sources arranged on the same ring-shaped body, wherein the pins have respective pairs of opposite axial ends which are housed in respective seats formed on adjacent bodies, each seat being delimited by a pair of separable opposed elements.

17. A variable configuration lighting apparatus, comprising a plurality of ring-shaped bodies, positioned about a central axis (A) and provided with respective plurality of lighting sources, in particular LEDs, and connected to one another by means of joints comprising pins so as to be differently oriented with respect to one another; the plurality of ring-shaped bodies being connected to one another by means of the pins made of electric conductive material and which contact pairs of electric terminals arranged on adjacent ring-shaped bodies, so that the adjacent ring-shaped bodies are rotational with respect to one another by means of the pins and are electrically connected by means of the same pins; the apparatus being characterized in that pairs of adjacent ring-shaped bodies are connected by at least one pin which supports the two ring-shaped bodies and contacts respective electric conductor blocks arranged on both said adjacent ring-shaped bodies and which include the terminals; and in that on each ring-shaped body each block contacts the pin and connects the pin to an electric circuit which supplies the sources arranged on the same ring-shaped body, wherein a first group of bodies are connected by pins aligned along a first direction, and a second group of bodies connected by pins aligned along a second direction distinct from the first direction and preferably orthogonal to the first direction.

* * * * *